US006971840B2

(12) United States Patent
Mulholland

(10) Patent No.: US 6,971,840 B2
(45) Date of Patent: Dec. 6, 2005

(54) METHOD OF ENHANCING THE AERODYNAMIC PERFORMANCE OF A FAN

(75) Inventor: Ronald G. Mulholland, Glasgow (GB)

(73) Assignee: Howden Power Limited, (GB)

( * ) Notice: Subject to any disclaimer, the term of this patent is extended or adjusted under 35 U.S.C. 154(b) by 16 days.

(21) Appl. No.: 10/655,077

(22) Filed: Sep. 4, 2003

(65) Prior Publication Data

US 2004/0042893 A1 Mar. 4, 2004

Related U.S. Application Data

(63) Continuation of application No. PCT/GB02/01156, filed on Mar. 13, 2002.

(30) Foreign Application Priority Data

Mar. 14, 2001 (GB) ..... 0106321

(51) Int. Cl.[7] ..... F04D 29/66

(52) U.S. Cl. ..... 415/1; 415/119; 415/123

(58) Field of Search ..... 415/1, 119, 123; 416/1, 500

(56) References Cited

U.S. PATENT DOCUMENTS

| | | | | |
|---|---|---|---|---|
| 3,910,717 | A | 10/1975 | Thome | |
| 4,688,989 | A | 8/1987 | Kondo et al. | |
| 4,993,276 | A * | 2/1991 | Edwards | 74/411.5 |
| 5,461,636 | A | 10/1995 | Karube et al. | |
| 5,759,011 | A * | 6/1998 | Moll | 415/170.1 |
| 6,638,203 | B2 * | 10/2003 | Carson et al. | 494/82 |

FOREIGN PATENT DOCUMENTS

| | | |
|---|---|---|
| EP | 0 219 578 | 4/1987 |
| GB | 1079331 | 4/1965 |

* cited by examiner

*Primary Examiner*—Ninh H. Nguyen
(74) *Attorney, Agent, or Firm*—McNair Law Firm, PA

(57) ABSTRACT

A fan is modified by replacing its rigid rotor shaft by a flexible shaft so the normal operating speed range is above the first transverse critical speed. During run-up, the assembly of the fan impeller 12 and the drive shaft 11 is accelerated rapidly through the first critical speed at which the peak transverse vibrations could be encountered, and during run-down the shaft 11 is braked to minimize the same exposure to transverse vibrations. The use of a more flexible fan drive shaft of smaller diameter, allows a higher fan operating speed to be used without risk of detrimental shaft aerodynamic chokage effects, and the utilization of the existing fan foundation.

7 Claims, 8 Drawing Sheets

METHOD OF ENHANCING THE AERODYNAMIC PERFORMANCE OF A FAN

CROSS REFERENCE TO RELATED APPLICATIONS

This application is a continuation of PCT//GBO2/01 156 filed Mar. 13, 2002 which claims priority from United Kingdom Patent Application Serial Number 0106321.3 filed Mar. 14, 2001.

FIELD OF THE INVENTION

The present invention relates to a method of enhancing the aerodynamic performance of a fan.

BACKGROUND OF THE INVENTION

It is known to provide for fans which are mounted on shafts such that the first transverse critical speed of the fan rotor is higher than the running speed of the fan. This is achieved by virtue of having a sufficiently stiff shaft to ensure that the fan impeller does not induce unacceptable flexural vibrations in the shaft until the rotational shaft speed is at a value well above the normal running speed of the fan impeller.

As a result of this requirement, the fan rotor shaft needs to be of considerable stiffness, requiring a substantial diameter to the fan shaft, and furthermore the mounting bearings of the shaft must be strong and stiff so as to resist any tendency for the assembly of the shaft and the impeller to vibrate by revolving around a fixed axis in the event that the first critical speed is attained. In other words, any such tendency for the fan impeller and its shaft to revolve due to out of balance masses on the impeller must not occur until a threshold speed above the normal running speed of the fan impeller.

SUMMARY OF THE INVENTION

In accordance with the present invention we provide a method of enhancing the aerodynamic performance of a fan having a first critical speed higher than the operating speed of the fan impeller, comprising replacing the fan rotor shaft by a second shaft of lesser rigidity and hence of smaller diameter, and operating the fan impeller at a speed or at a range of speeds which is higher than the first critical speed of the fan impeller. Where the fan impeller is intended to be operated over a range of rotational speeds after modification by the method of the invention, the first critical speed must be below the operating range. Preferably any second critical speed is above the normal running speed or normal running range.

A fan operating system enhanced by the method of this invention has the advantage that the shaft can be relatively flexible, and therefore of smaller diameter than is conventional in order to ensure that a fan impeller of a given moment of inertia can be operated without undesirable vibrations. Hence, in the case of a double-inlet centrifugal fan the available intake cross-sectional area of the fan impeller is enhanced as compared with the reduced area available for a larger diameter but stiffer shaft. In such cases this will ensure that detrimental shaft chokage at the impeller inlet, which would otherwise preclude the selection of a suitable fan, is eliminated.

The invention also offers the possibility of a retrofit in which an existing large fan impeller can be replaced by one of smaller diameter with a smaller diameter, more flexible rotor shaft, and operated at a higher rotational speed so as to provide an enhanced aerodynamic performance as compared with that of the large diameter fan impeller previously installed. It allows operation with the same shaft mountings as there is no longer any need to mount the shaft stiffly to avoid the coincidence of the first transverse critical speed with the normal running speed, or normal running speed range, of the fan operating system.

Preferably the fan impeller and shaft assembly may be braked during run-down to minimise the duration of the transition through the first critical speed.

BRIEF DESCRIPTION OF THE DRAWINGS

In order that the present invention may be more readily understood, the following description is given, merely by example, with reference to the accompanying drawings in which.

DETAILED DESCRIPTION OF THE INVENTION

Figure 1:
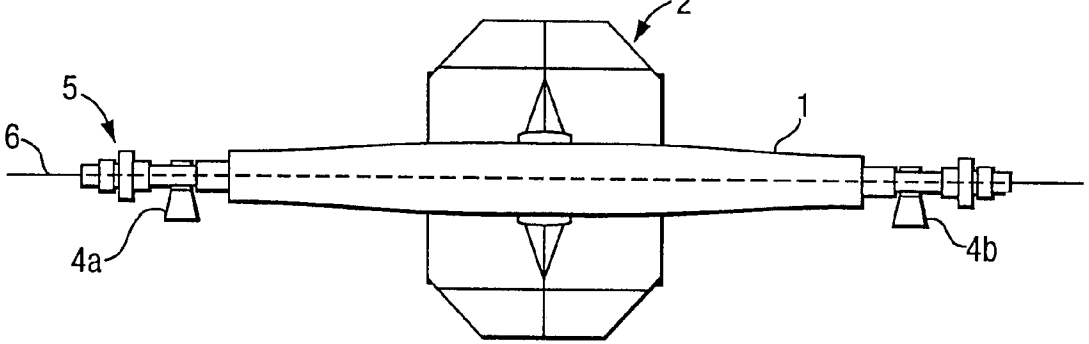
FIG. 1 is a partly schematic side-elevational view showing a conventional double-inlet impeller having a stiff shaft providing for the first critical speed to be above the normal operating speed of the impeller.

Referring now to FIG. 1, the shaft 1 supporting the double-inlet centrifugal impeller 2 has a tapering profile from a widest part at the center of the rotor to a narrowest part near each end of the shaft. This is a typical shaft design for large double inlet fans, but parallel solid shafts or hollow shafts can also be used. The shaft 1 is driven by an electric motor 5 shown only schematically in FIG. 1.

The air or other gas being pumped by the fan enters the interior of the fan from the left-hand side and from the right-hand side of the double-inlet impeller and exits radially outwardly, with a circumferential flow component, so the difference between the external periphery of the shaft 1 at its wider diameter central region and the internal diameter of the impeller 2 surrounding that portion of the shaft defines the cross-sectional area for gas being pumped by the fan impeller and must be as large as is possible. Since the internal diameter of the impeller is fixed by its geometric proportions this can only be achieved by minimizing the diameter of the shaft.

With the conventional fan operating system the rotor shaft bearings 4*a* and 4*b* shown schematically in FIG. 1 must be strong enough to hold the shaft ends so as to support the combined weight of the shaft 1 and the fan impeller 2, but also so as to be able to absorb any tendency for lateral vibration of the impeller shaft, for example a tendency to revolve about the geometric axis 6 of the shaft when the impeller is being run at its normal operating speed, or within its normal operating speed range, so that the first critical speed is kept as high as possible and therefore well above the normal operating speed, or normal operating speed range.

Figure 2:
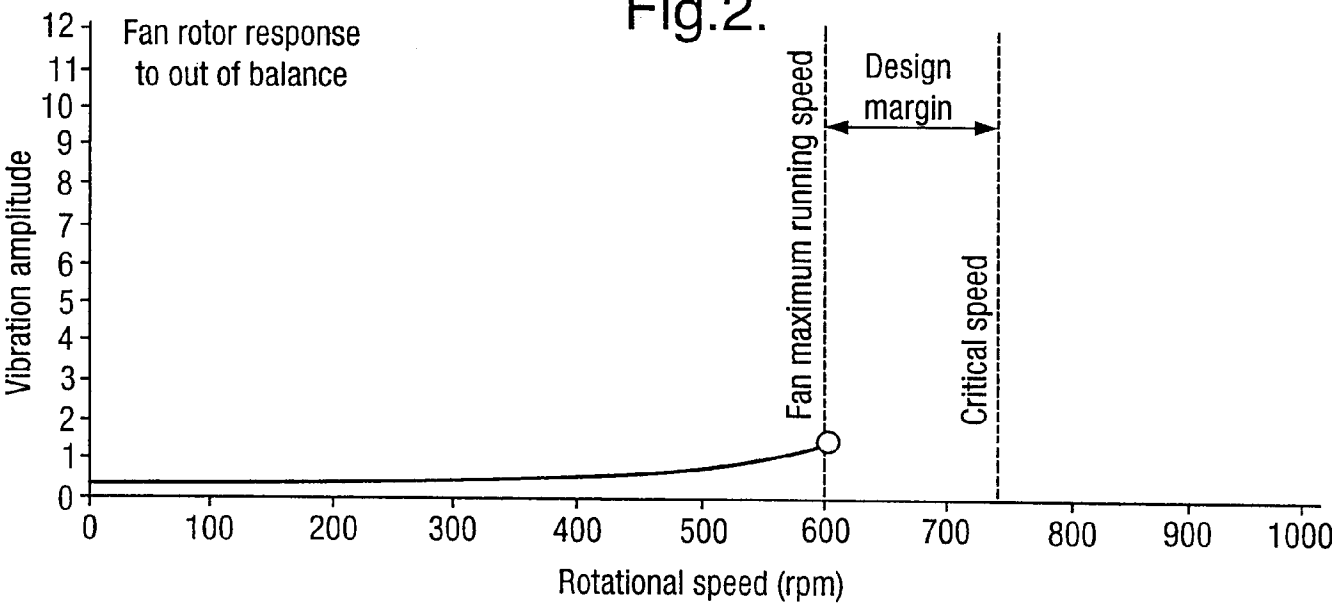
FIG. 2 is a graph plotting vibration amplitude vs. rotational speed and showing the normal operating speed range and the approach to the first critical speed in the case of the fan of FIG. 1.

FIG. 2 shows the vibration amplitude increasing to a maximum amplitude of one unit at the rotational speed of 600 revolutions per minute in the case where the critical speed of the fan and shaft assembly is 750 revolutions per minute, i.e. well above the fan maximum running speed. If this design margin shown in FIG. 2 were not available, the fan impeller and shaft assembly would undergo dangerous transverse vibration even at the maximum running speed of the fan.

The arrangement shown in FIGS. 1 and 2 is that of a conventional double-inlet centrifugal fan.

Figure 3:
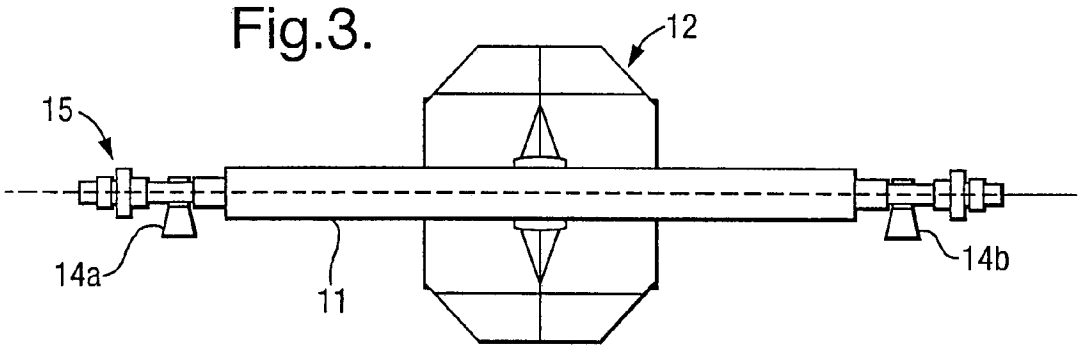
FIG. 3 is a view, corresponding to FIG. 1, but showing a modification, in accordance with the present invention, with a larger diameter fan impeller supported by a smaller diameter shaft which is therefore more flexible but is operated.

FIG. 3 shows the system modified in accordance with the present invention where the shaft no longer needs to be so stiff and can more readily be of non-tapering form, thereby allowing a smaller diameter central region of the shaft 11 and thereby increasing the inlet area for a given impeller internal diameter. Nevertheless the strength of the bearings 14*a* and 14*b* of the rotor shaft can be the same as for FIG. 1.

Figure 4:
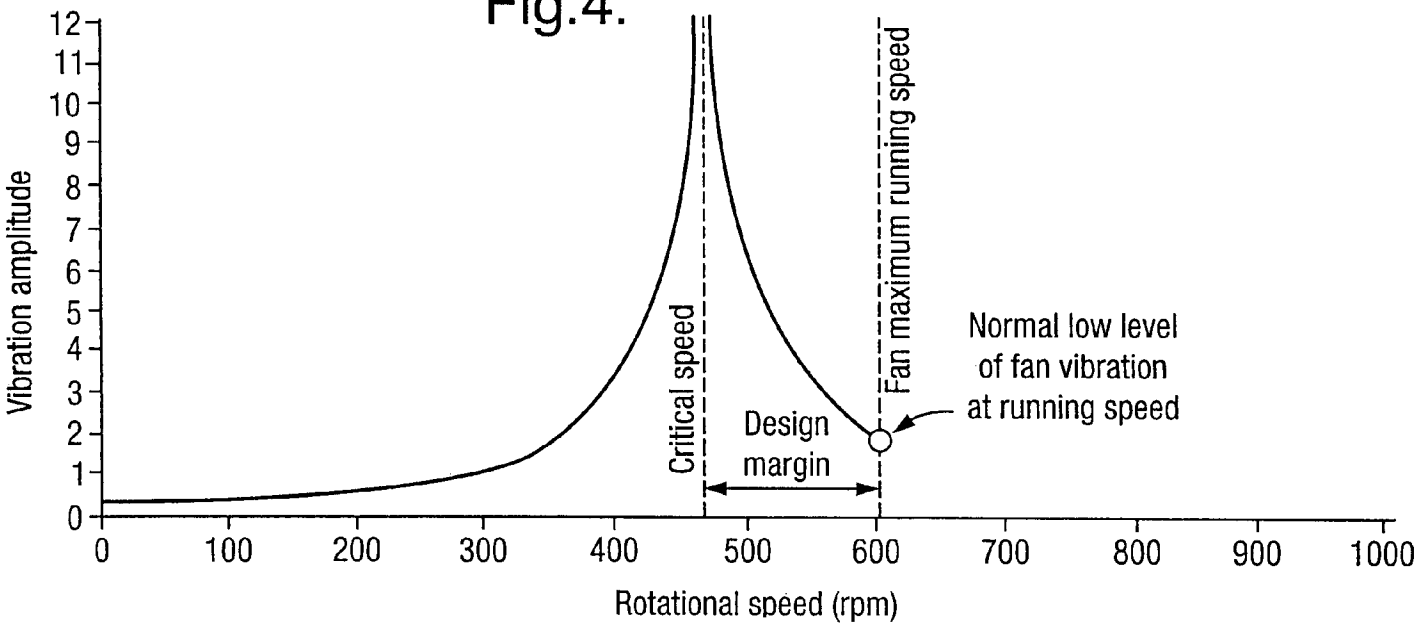
FIG. 4 is a graph corresponding to FIG. 2, but showing the operating characteristics of the fan of FIG. 3.

In the case of the fan of FIG. 3 there is a surprising difference in that the fan needs to be run up through the first critical speed in order to attain its normal operating speed or its normal operating speed range, and the design margin, which in FIG. 1 represents the difference in rotational speeds between the relatively high first critical speed and the lower speed normal operating range, is reversed in that in the case of FIG. 4 that design margin is the difference between the relatively low first critical speed and the minimum running speed which is now higher than the first critical speed.

The fan motor 15 will have a power rating adequate to provide the maximum power absorbed by the fan at its maximum operating speed. It is envisaged that the fan rotor will thus be accelerated rapidly through its first critical speed so that no problems of transverse vibration will be encountered during run up. However, if the fan is allowed to coast down through its first critical speed it is likely to have a deceleration value the modulus of which is less than the acceleration of the fan on run up, and in such a situation it may be desirable to provide an optional brake for decelerating the fan impeller more rapidly to reduce the duration of exposure to transverse vibrations as it passes down through the first critical speed band. However it is not expected that the use of a brake will in itself reduce the amplitude of those transverse vibrations.

The required braking can be provided by various means, such as a shaft mounted disc brake or electrical braking acting directly on the main drive motor.

Figure 5A:
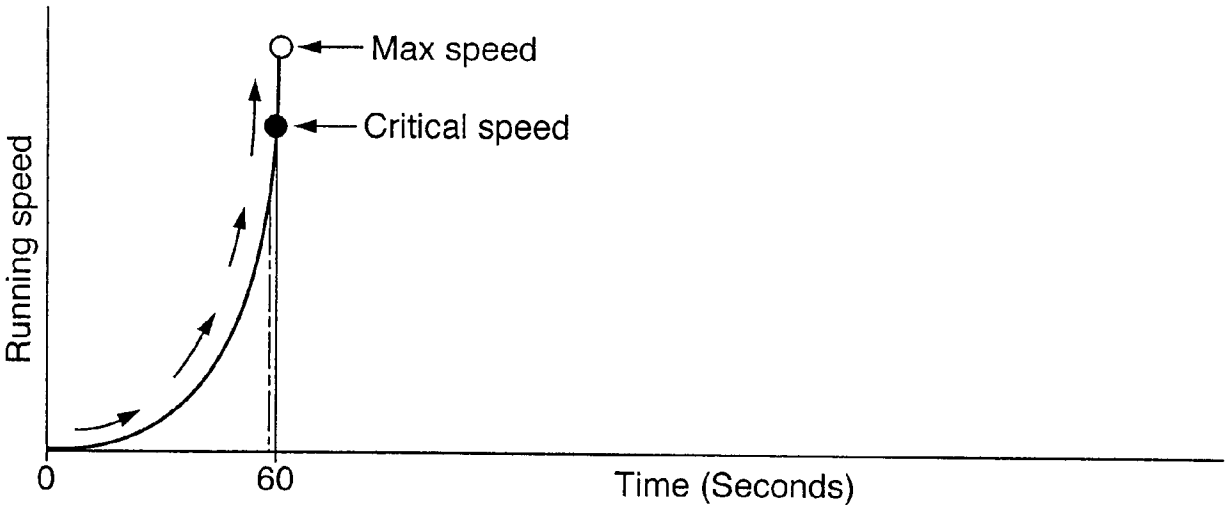
FIGS. 5*a* and 5*b* are graphs plotting the running speed vs. time (for FIG. 5*a*) and the vibration amplitude time against running speed (for FIG. 5*b*), for running up the fan of FIG. 3.

FIG. 5*a* shows the run-up condition when the fan running speed is being increased through the critical speed to the maximum speed, with the speed plotted against time so as to illustrate the very short time interval during which the impeller is accelerating through the first critical speed. This short time interval results from the asymptotic curve in FIG. 5*a*.

Figure 5B:
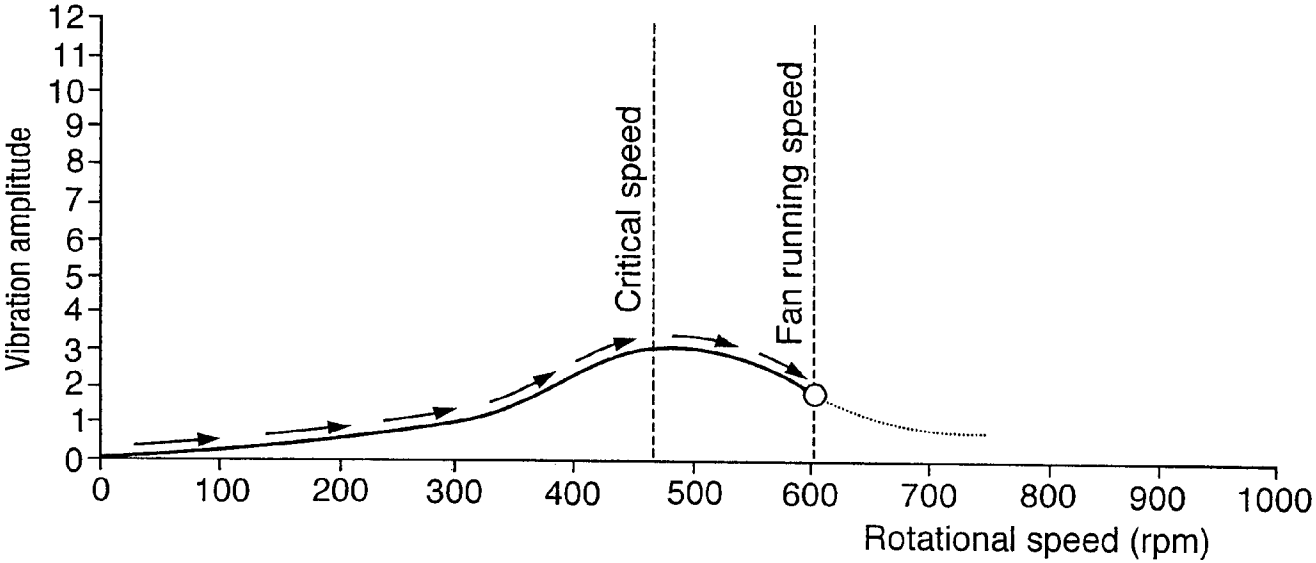

FIG. 5*b* shows a plot of vibration amplitude (measured by units 1 to 12) against the rotational speed and shows that the rate of increase of vibration is slightly increased from about 75% of first critical speed up to that peak and that the curve is a mirror image during drop-off of vibration amplitude during increase beyond the first critical speed. The normal fan running speed is in this case approximately 30% above the first critical speed, and at this speed an adequate safety margin is provided.

Figure 6A:
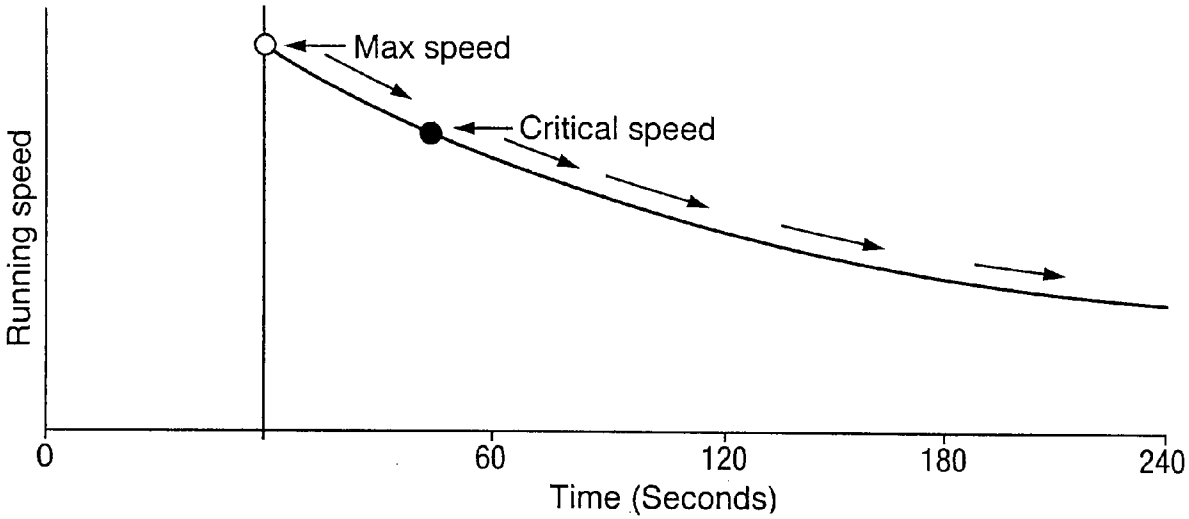
FIGS. 6*a* and 6*b* are curves corresponding to FIGS. 5*a* and 5*b* but applicable to the coasting run-down of the fan of FIG. 3.
Figure 6B:
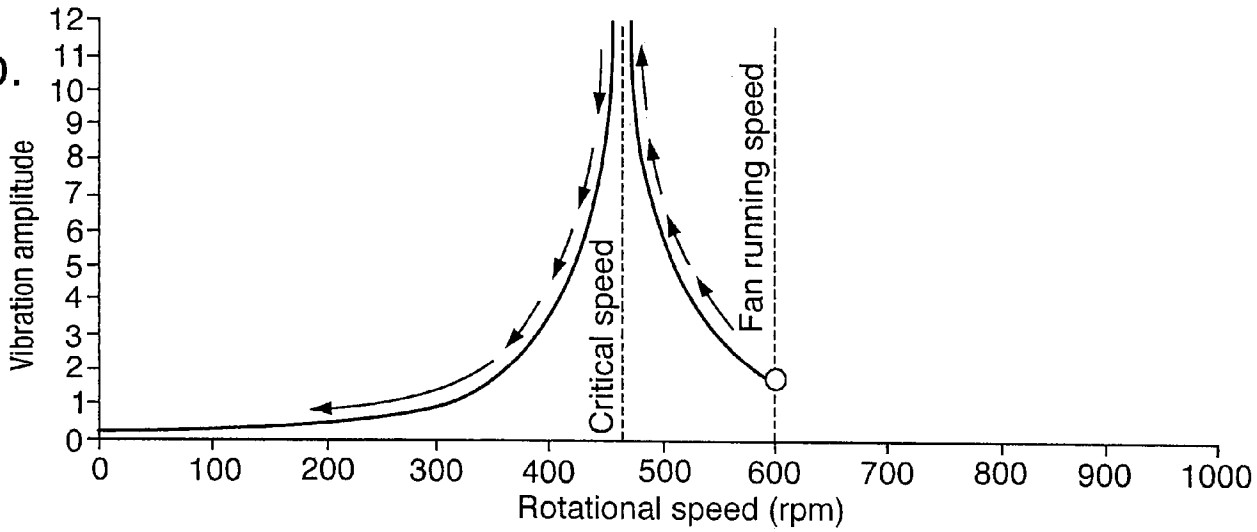

FIG. 6*a* shows another plot of running speed against time, corresponding to FIG. 5*a*, and shows that in the absence of braking there can be a considerable time interval during which the rotational speed is at or near its first critical speed value during free running-down of the fan. FIG. 6*b*, plotting the vibration amplitude against rotational speed shows the considerable increase in fan vibration, to a peak of more than 12 units, during the (coasting) run-down in the absence of braking.

As indicated above, by having an optional rotor brake to reduce the fan impeller speed much more rapidly during run-down there will be a much shorter exposure to the vibrations resulting from passing through the first critical speed band, and the result of this will be to lower the peak of the curve in FIG. 6*b*, in order to bring the degree of vibration amplitude experienced during run-down down to somewhat nearer the maximum vibration amplitude experienced during run-up (FIG. 5*b*).

As indicated above, the fan operating system modified in accordance with the present invention preferably includes a motor capable of rapid acceleration through the first critical speed value and may include a rotor brake capable of reducing the time interval when the rotational speed of the rotor is close to its first critical value.

The present invention provides not only a new design concept in enhancing the operation of a fan, but also a way of more cheaply improving the aerodynamic performance of a fan installation by allowing the use of smaller shaft bearings with a narrower diameter shaft with a larger diameter fan impeller so as to provide for a much greater diameter difference between the internal diameter of the impeller and the external diameter of the shaft, and hence to provide for a much greater cross-sectional area of pumped gas flow than for a conventional fan.

The term "flexible shaft" used within the present application generally implies that the first critical speed of the assembly of fan impeller and shaft is lower than the normal operating speed of that fan.

It will of course be understood, in the context of retrofitting a fan by the present invention (FIGS. 3 and 4) in place of the conventional fan of FIGS. 1 and 2, it is possible to replace the original impeller by a smaller impeller running at a higher rotational speed (above the first critical speed) and nevertheless still to achieve an enhanced aerodynamic performance of the retrofit fan. This would not be possible if the critical speed must always be above the maximum running speed, and therefore represents a significant advantage offered by the present invention. Such a smaller impeller can also be cheaper to produce and, taking into account the ability to operate on the original shaft bearings, no longer requiring strengthening, this provides a considerable economic advantage.

EXAMPLE

Figure 7A:
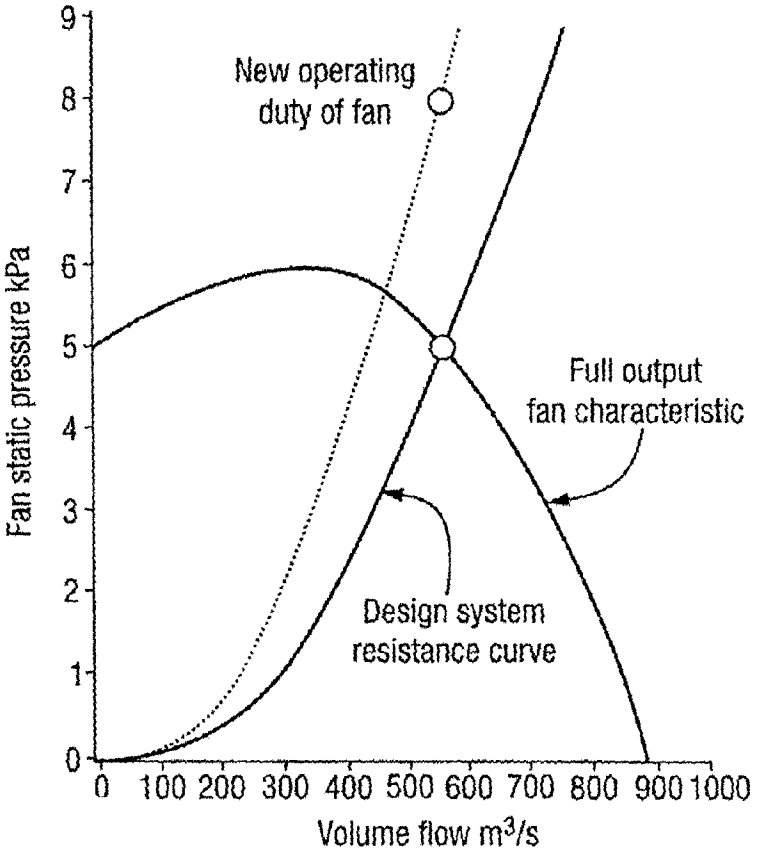
FIGS. 7*a*, 7*b* and 7*c* illustrate an example of a retrofit situation where the original fan impeller and shaft are shown in FIG. 7*a*, a hypothetical modification according to traditional thinking is shown in FIG. 7*b*, and a retrofit modification in accordance with the present invention is shown in FIG. 7*c*.
Figure 7A:
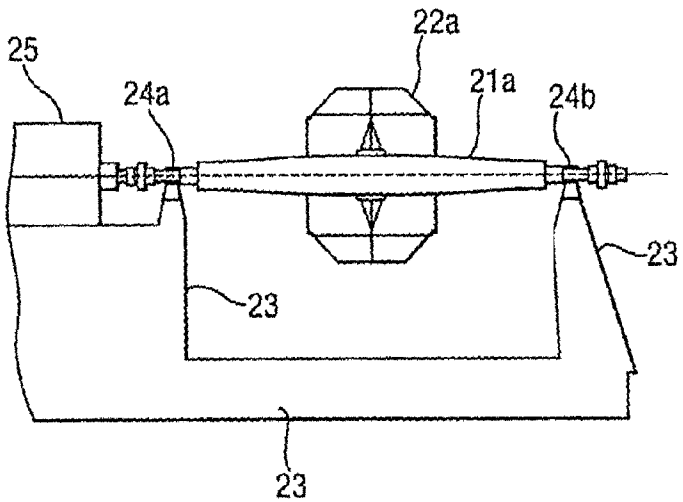
Figure 7B:
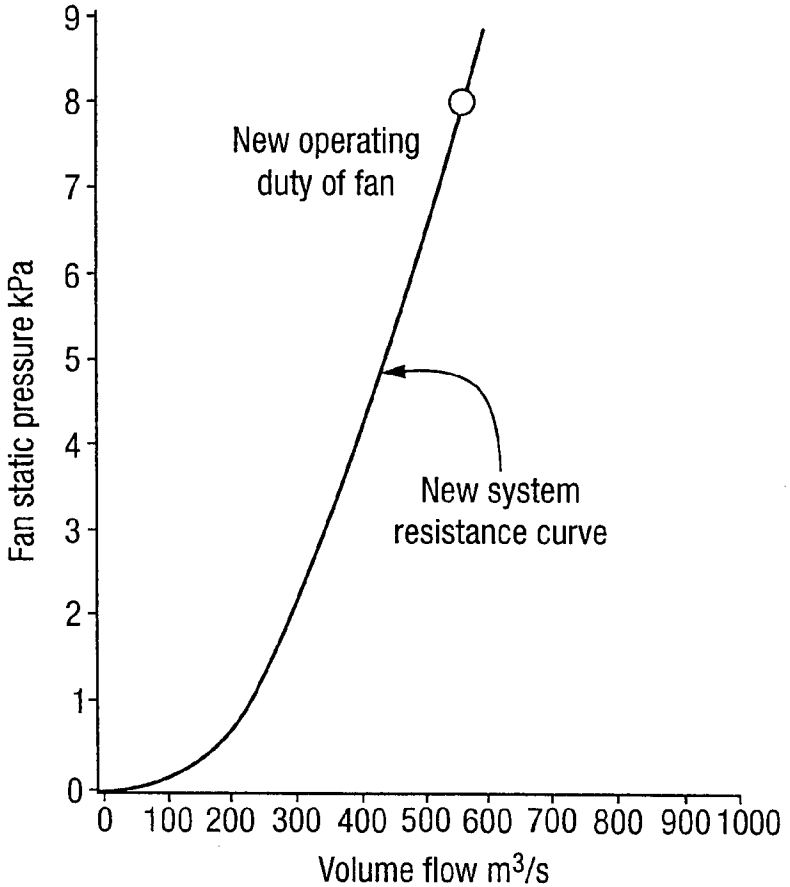
Figure 7B:
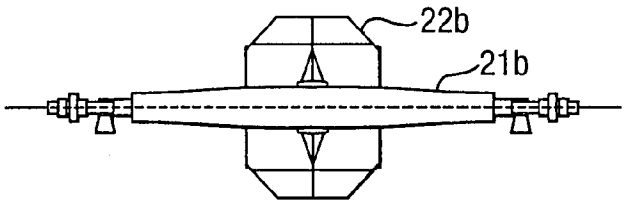
Figure 7C:
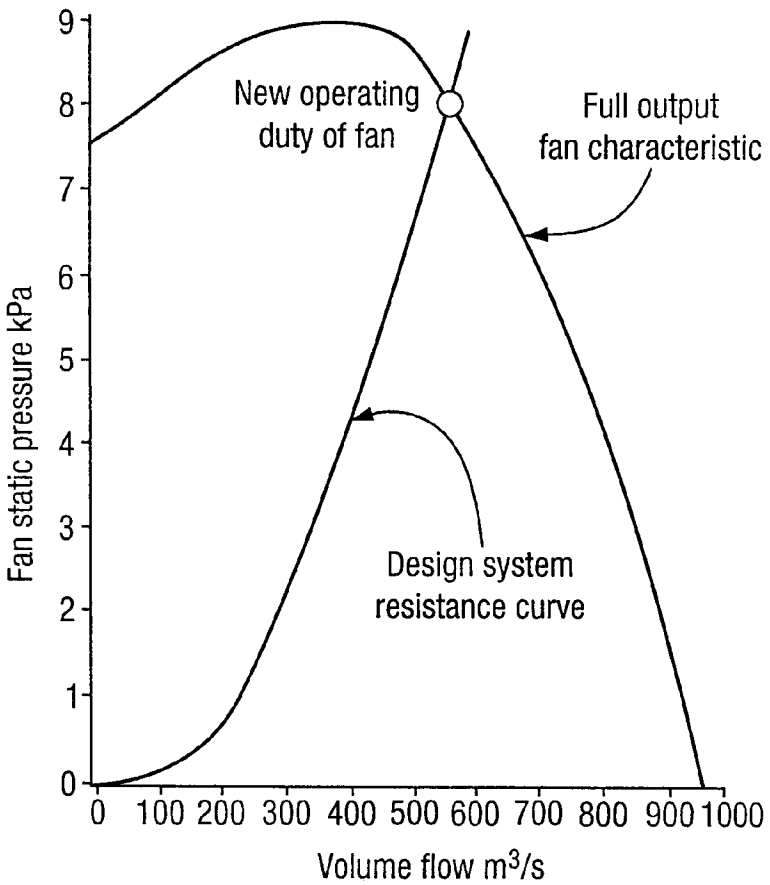
Figure 7C:
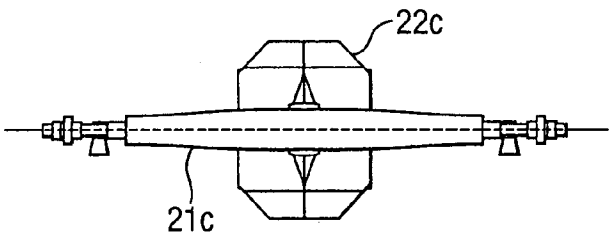

FIGS. 7*a*, 7*b* and 7*c* show an example of a retrofit situation in the case of a double-inlet centrifugal fan in which the impeller/shaft combination in accordance with the present invention is shown at FIG. 7*c* as a modification of the original installation shown in FIG. 7*a*, and FIG. 7*b* shows what would have been carried out if traditional thinking had been followed. The installation of FIG. 7*b* is therefore not in accordance with the present invention.

The arrangement shown in FIG. 7*a* has an impeller 22*a* operating at a design speed of 890 rpm with a stiff rotor shaft 21*a* supported at each end by bearings 24*a* and 24*b*, respectively. These bearings are themselves supported on upstanding arms of a foundation assembly 23 which also supports a fan drive motor 25. FIG. 7*a* also shows, as plots of fan static pressure in kiloPascals (kPa) against volumetric flow rate in $m^3/s$, (i) the full output fan characteristic, (ii) the design system resistance curve which intersects the full output fan characteristic at the maximum operating duty of the fan of FIG. 7*a*, and also (iii) the desired new operating duty of the fan, resulting in an increase in the rotational speed to 1185 rpm.

FIG. 7*b* shows this higher operating speed fan assembly with the conventional stiff rotor shaft 21*b* supporting the impeller 22*b* which can be smaller than impeller 22*a* of FIG. 7*a*, by virtue of the increased rotational speed. However, FIG. 7*b* also shows that the shaft 21*b* of this modification needs to be larger in diameter to ensure that the first critical speed is above the higher running speed of the replacement fan. Consequently the diameter of the shaft 21*b* in the vicinity of the impeller 22*b* is considerably larger than was the case for the original fan of FIG. 7*a*, and the fluid inflow path suffers considerable chokage which will prove unacceptable to the fan operation.

On the other hand, FIG. 7*c* again shows an arrangement in which the impeller is rotating at 1185 rpm, and the maximum diameter of the impeller 22*c* of FIG. 7*c* is the same as that of impeller 22*b* of FIG. 7*b* (but smaller than that of FIG. 7*a*), but the impeller 22*c* differs in that it is supported on a flexible, smaller diameter shaft 21*c* which allows the area of inlet to the impeller to be substantially greater and hence provides an improved full output fan characteristic which is also shown in FIG. 7*c*. The new operating duty of the fan, again defined by the intersection of the design system resistance curve and the full output fan characteristic, is now much higher at around 8 kPa as compared with 5 kPa for the fan of FIG. 7*a*.

As a result, the modification required to replace the impeller 22*a* and shaft 21*a* of FIG. 7*a* by the smaller diameter impeller 22*c* and flexible shaft 21*c* of FIG. 7*c* can be achieved during a normal plant shutdown period while other essential maintenance is performed, thereby avoiding lost commercial operating time.

Although FIGS. 1 to 7 are related to a double-inlet centrifugal fan, the present invention can also be applied to a single-inlet centrifugal fan or to a single-inlet fan employing axial flow, or to single-inlet fan employing mixed centrifugal and axial flow.

Figure 8A:
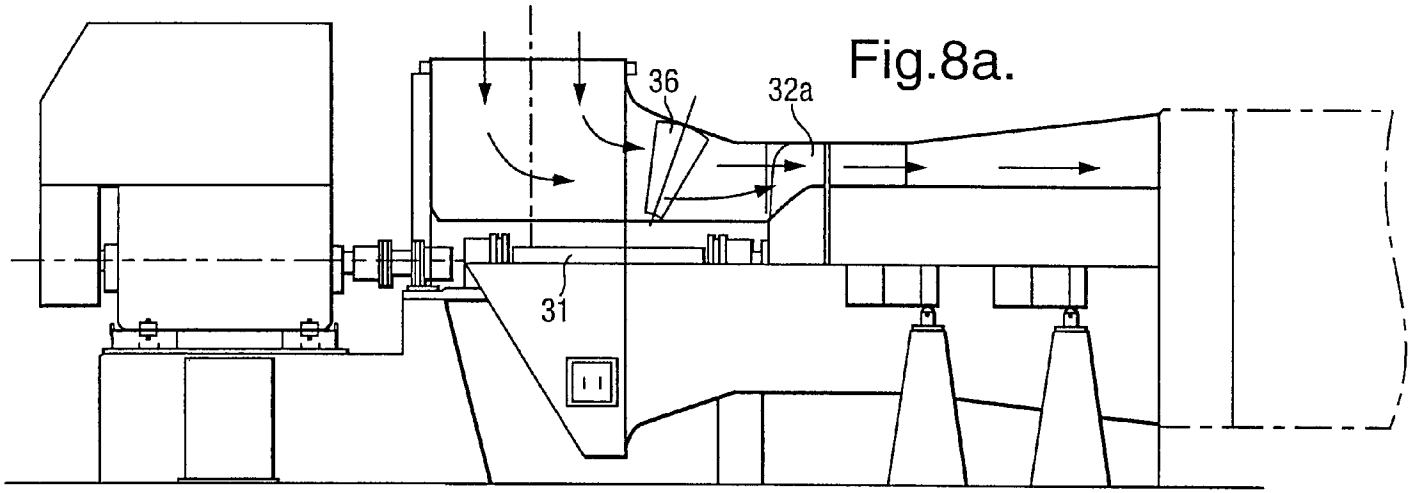
FIGS. 8*a* and 8*b* show a single inlet fan with, respectively, mixed axial and centrifugal flow and pure axial flow.

FIG. 8*a* shows such a single-inlet fan employing mixed axial and centrifugal flow where the fluid approaching the rotor 32*a* follows an axial flow path and undergoes a partial alteration into radially inward and axial flow, following which it is deflected radially outwardly by deflector blades 36 to be discharged along a direction perpendicular to the access of the fan rotor 31.

Figure 8B:
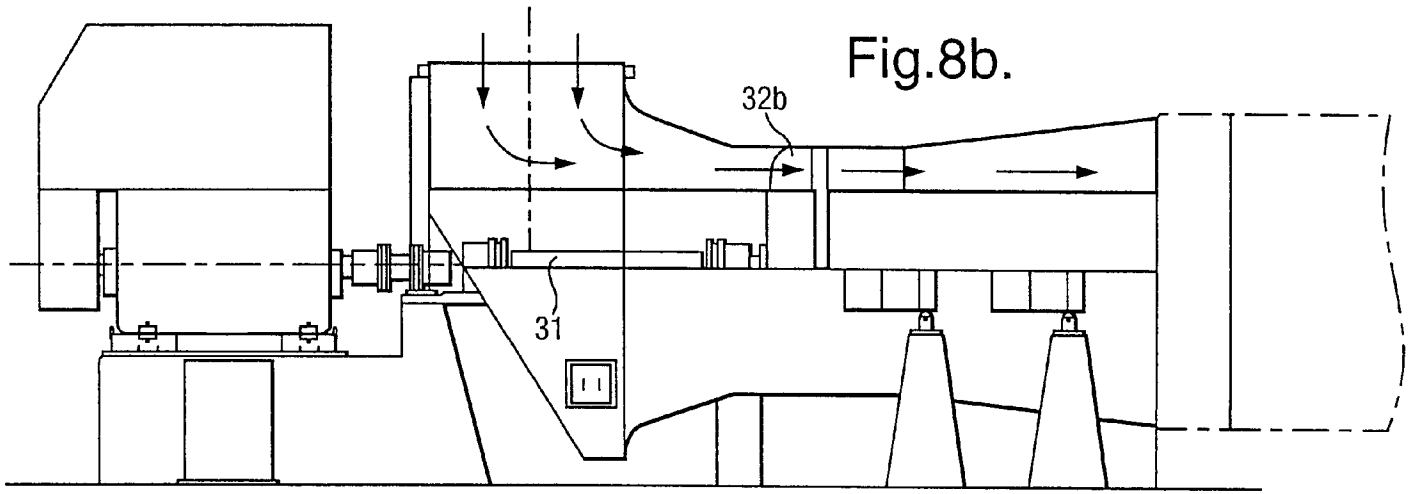

FIG. 8*b* shows a generally similar fan arrangement, but where the fan rotor 32*b* merely induces axial flow in the incident air, then discharging it axially to be deflected along a path perpendicular to the axis of rotation of the rotor shaft 31.

Although not shown in the drawings, the present invention can also be used with a single inlet centrifugal fan where effectively the rotor is one half of the fan impeller shown in FIGS. 1 and 3.

The advantages of the present invention with relation enhancement of a double-inlet centrifugal fan have been well described and illustrated above as offering both the need for unreinforced bearing mountings and also the opportunity of providing a larger cross-sectional flow passage of the air. In the case of the single-inlet fan the effect of the shaft redesign on the aerodynamic flow path is much less or even negligible, as can be seen from FIGS. 8*a* and 8*b* where the annular airflow path is spaced radially outwardly from the cylindrical surface of the shaft 31. Nevertheless, the advantages of being able to avoid strengthening of the bearing foundations when upgrading to a higher fan rotor speed can be appreciated both with the single-inlet centrifugal fan type and with the mixed flow and axial flow types such as are illustrated in FIGS. 8*a* and 8*b*.

What is claimed is:

1. A method of enhancing the aerodynamic performance of a fan having a first critical speed higher than the operating speed of the fan impeller, comprising replacing the fan rotor shaft by a second shaft of lesser rigidity and hence of smaller diameter, and operating the fan impeller at a speed or at a range of speeds which is higher than the first critical speed of the fan impeller.

2. A method according to claim 1, including replacing the original fan impeller by a second fan impeller having an impeller inlet area sufficient to avoid shaft aerodynamic chokage effects.

3. A method according to claim 2, including the step of using the same rotor shaft bearings and adding a brake to reduce the time of exposure of the impeller and shaft assembly to the transverse vibration resulting from transition through the first critical speed.

4. A method according to claim 1, including the step of using the same rotor shaft bearings and adding a brake to reduce the time of exposure of the impeller and shaft assembly to the transverse vibration resulting from transition through the first critical speed.

5. A method of enhancing the aerodynamic performance of a fan having a first critical speed higher than the operating speed of the fan impeller, comprising replacing the fan rotor shaft by a second shaft of lesser rigidity and hence of smaller diameter, and operating the fan impeller at a speed or at a range of speeds which is higher than the first critical speed of the fan impeller and replacing the original fan impeller by a second fan impeller having an impeller inlet area sufficient to avoid shaft aerodynamic chokage effects.

6. A method of enhancing the aerodynamic performance of a fan having a first critical speed higher than the operating speed of the fan impeller, comprising replacing the fan rotor shaft by a second shaft of lesser rigidity and hence of smaller diameter, and operating the fan impeller at a speed or at a range of speeds which is higher than the first critical speed of the fan impeller, including the step of using the same rotor shaft bearings and adding a brake to reduce the time of exposure of the impeller and shaft assembly to the transverse vibration resulting from transition through the first critical speed.

7. A method of enhancing the aerodynamic performance of a fan having a first critical speed higher than the operating speed of the fan impeller, comprising replacing the fan rotor shaft by a second shaft of lesser rigidity and hence of smaller diameter, and operating the fan impeller at a speed or at a range of speeds which is higher than the first critical speed of the fan impeller and replacing the original fan impeller by a second fan impeller having an impeller inlet area sufficient to avoid shaft aerodynamic chokage effects, including the step of using the same rotor shaft bearings and adding a brake to reduce the time of exposure of the impeller and shaft assembly to the transverse vibration resulting from transition through the first critical speed.

* * * * *